US007604483B2

(12) United States Patent
Takada et al.

(10) Patent No.: US 7,604,483 B2
(45) Date of Patent: Oct. 20, 2009

(54) INTERMEDIATE ELECTRICAL CONNECTOR DEVICE AND ITS CONNECTING STRUCTURE

(75) Inventors: Toshiyuki Takada, Tokyo (JP); Tadashi Ohshida, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/003,128

(22) Filed: Dec. 20, 2007

(65) Prior Publication Data

US 2008/0242161 A1 Oct. 2, 2008

(30) Foreign Application Priority Data

Mar. 30, 2007 (JP) ..... 2007-090301

(51) Int. Cl.
*H01R 12/00* (2006.01)

(52) U.S. Cl. ..... 439/66; 439/591; 439/74; 439/701

(58) Field of Classification Search ..... 439/66, 439/591, 91, 65, 76.1, 701, 74
See application file for complete search history.

(56) References Cited

U.S. PATENT DOCUMENTS 6,341,966 B1 * 1/2002 Takada et al. ..... 439/108
6,960,096 B2 * 11/2005 Takada ..... 439/377
7,338,291 B2 * 3/2008 Takada ..... 439/65
7,445,467 B1 * 11/2008 Matsuo ..... 439/74
2005/0170675 A1 * 8/2005 Takada ..... 439/66

FOREIGN PATENT DOCUMENTS

JP 04-49472 U 4/1992
JP 2005-216694 8/2005

* cited by examiner

*Primary Examiner*—Renee S Luebke
*Assistant Examiner*—Vanessa Girardi
(74) *Attorney, Agent, or Firm*—Kubotera & Associates, LLC

(57) ABSTRACT

An electrical connector assembly has a fixed connector, a middle connector, and a plug connector. The fixed connector is attached to a circuit member of an electrical device. The middle connector is connected and pulled out to and from the fixed connector in a direction same as that of the plug connector being connected and pulled out to and from the middle connector. Each of the fixed connector, the middle connector, and the plug connector is provided with engagement portions at both end portions thereof in a direction parallel to a straight line extending in a different direction from an insertion and pull-out direction. With the engagement portions, it is possible to prevent the fixed connector from coming off from the middle connector when the plug connector is pulled out.

7 Claims, 8 Drawing Sheets

INTERMEDIATE ELECTRICAL CONNECTOR DEVICE AND ITS CONNECTING STRUCTURE

BACKGROUND OF THE INVENTION AND RELATED ART STATEMENT

The present invention relates to an electrical connector assembly. The electrical connector assembly comprises a fixed connector, a middle connector, and a plug connector. The fixed connector is fixed to a circuit member of an electrical device. The middle connector is fitted into the fixed connector. Further, the plug connector is fitted and connected to the middle connector.

Patent Reference has disclosed an electrical connector assembly comprising a middle connector having a circuit board, a fixed connector, and a plug connector. The fixed connector and the plug connector are connected to the middle connector on each side thereof facing each other. In Patent Reference, both of the fixed connector and the plug connector are referred to as connected bodies.

Patent Reference Japanese Patent Publication No. 2005-216694

According to Patent Reference, the fixed connector is attached to the circuit board fixed to an electronics device. Further, the plug connector is connected to, for example, another circuit board. Connection pads, i.e., lead distal ends of a circuit, are arranged on both facing edge portions of the circuit board of the middle connector. Terminals of the fixed connector and the plug connector are connected to the connection pads of each of the edge portions of the circuit board.

In the electrical connector assembly, the middle connector is pulled out from the fixed connector at a frequency smaller than that of the plug connector being pulled out from the middle connector. The middle connector and the fixed connector are provided with engagement portions having claw shapes to securely engage the middle connector and the fixed connector. Accordingly, when the plug connector is pulled out from the middle connector, the middle connector is not pulled out from the fixed connector.

When the middle connector is pulled out from the fixed connector, the engagement portions are deformed with a tool in a releasing direction to pull out the middle connector.

In the electrical connector assembly described above, a user may attempt to pull out the middle connector from the fixed connector in the same manner as pulling out the plug connector without using a tool. In this case, it is difficult to pull out the middle connector easily. Accordingly, the user may attempt to pull out the middle connector so hard that the middle connector and the fixed connector receive an excessive force, thereby damaging the middle connector and the fixed connector.

In view of the problems described above, an object of the present invention is to provide an electrical connector assembly in which a middle connector is not pulled out when a plug connector is pulled out. In the electrical connector assembly, when the middle connector is intentionally pulled out, it is possible to pull out the middle connector without a tool.

Further objects of the invention will be apparent from the following description of the invention.

SUMMARY OF THE INVENTION

In order to attain the objects described above, according to the present invention, an electrical connector assembly has a fixed connector, a middle connector, and a plug connector.

The fixed connector is attached to a circuit member of an electrical device. The middle connector fits and is connected to the fixed connector. The plug connector fits and is connected to the middle connector.

In the electrical connector assembly, the middle connector is connected and pulled out to and from the fixed connector in a direction same as that of the plug connector being connected and pulled out to and from the middle connector. Further, each of the fixed connector, the middle connector, and the plug connector is provided with engagement portions at both end portions thereof in a direction parallel to a straight line extending in a different direction from an insertion and pull-out direction. With the engagement portions, it is possible to prevent the fixed connector from coming off from the middle connector when the plug connector is pulled out.

In the electrical connector assembly, the middle connector and the fixed connector are provided with the engagement portions, so that the middle connector and the fixed connector engage with each other in a connector pull-out direction while fitting into each other. An engaging force at the engagement portions is larger than a pull-out force between the middle connector and the plug connector. The middle connector may relatively move for a specific distance with respect to the fixed connector in a direction parallel to the straight line.

When the middle connector relatively moves for the specific distance, one of the engagement portions of the middle connector at the both end portions is released from the engagement with respect to the engagement portion of the fixed connector.

In the electrical connector assembly with the configuration described above, when only the plug connector is to be pulled out, the plug connector can be simply pulled out as in a case of a normal connector. The engagement force of the middle connector and the fixed connector is larger than the pull-out force of the plug connector from the middle connector. Accordingly, even though the plug connector is pulled out, the middle connector does not come off from the fixed connector.

When the middle connector is to be pulled out from the fixed connector, the middle connector moves for a specific distance in the direction of the straight line different from the insertion and pull-out direction of the middle connector. Accordingly, one of the engagement portions of the middle connector is released from the corresponding engagement portion of the fixed connector. When one of the engagement portions is pulled in the pull-out direction at this time, the middle connector is inclined and pulled out from the one of the engagement portions. Thus, the engagement at the other engagement portion is released, and the middle connector is pulled out.

Even though the user does not know how to pull out the middle connector, when the middle connector is pulled out in the same direction as the pull-out direction of the plug connector, the middle connector is not pulled out with ease. Accordingly, the user may attempt to twist the middle connector. As a result, the middle connector receives a force in the direction of the straight line and moves for the specific distance. Accordingly, the engagement in one of the engagement portions is released.

According to the present invention, each connector may be provided with a plurality of contact portions to connect with a mating connector. The contact portions are arranged in a straight line direction that the engagement portions at the both end portions of the connectors are connected.

An arrangement direction of the contact portion of the connector is in many cases a longitudinal direction. Accordingly, in such a configuration, a slope formed when the middle connector is lifted upon releasing of the engagement at one of the engagement portions becomes small. As a result, the middle connector can be pulled out with ease.

According to the present invention, the engagement portions of the middle connector and the fixed connector may be provided as engagement arms having claw portions at distal portions thereof for engaging with each other in the pull-out direction of the middle connector. At least one of the engagement arms of the middle connector and the fixed connector is elastically displaced so as to allow a relative move of the connectors for a specific distance therebetween. Accordingly, the engagement at the claw portions is released.

According to the present invention, the middle connector has a middle board and a frame body. The middle board is provided for conducting between the fixed connector and the plug connector. The frame body supports the middle board. The middle connector may relatively move with respect to the fixed connector through supporting the middle board to be relatively movable by the frame body. The middle board is connected to the fixed connector.

In the present invention, as described above, when the middle connector is moved in the direction of the straight line different from the insertion and pull-out direction of the connector, the engagement of the engagement portions of the middle connector and the fixed connector are released. Accordingly, when only the plug connector is pulled out, the middle connector is pulled out at the same time.

When the middle connector is to be pulled out, the middle connector moves in the direction of the straight line different from the insertion and pull-out direction, so that the engagement of one of the engagement portions is released without using a tool. Accordingly, the middle connector is inclined, so that the middle connector is pulled out from the fixed connector on the side of one of the engagement portions.

DETAILED DESCRIPTION OF PREFERRED EMBODIMENTS

Hereunder, embodiments of the Present invention will be explained with reference to the accompanying drawings.

Figure 1:
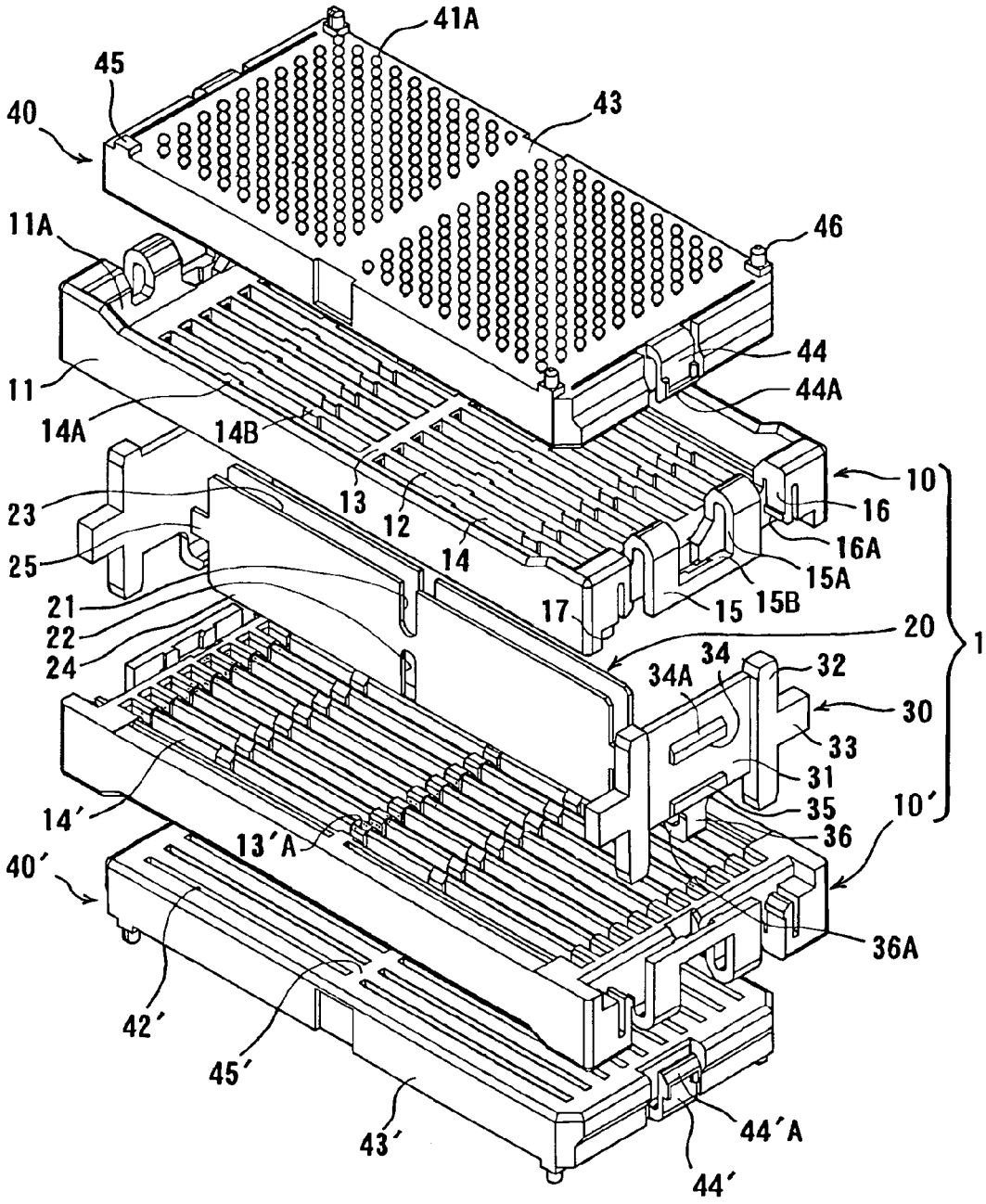
FIG. 1 is a perspective view showing an electrical connector assembly in a separated state according to an embodiment of the present invention.

FIG. 1 is a perspective view showing an electrical connector assembly in a separated state according to an embodiment of the present invention. The connector assembly comprises a fixed connector 40', a middle connector 1, and a plug connector 40. The fixed connector 40' is fixed to circuit boards P and P' (shown in FIG. 2). The circuit boards P and P' are circuit members of an electrical device. The middle connector 1 is connected to the fixed connector 40'. Further, the plug connector 40 is connected to the middle connector 1.

The middle connector 1 comprises two sub members 10 and 10', middle boards 20, and joining members 30. The middle boards 20 are held with the sub members 10 and 10'. The joining members 30 join the two sub members 10 and 10'. The sub members 10 and 10', the middle boards 20, and the joining members 30 are assembled to be the middle connector 1. The sub members 10 and 10' and the joining members 30 form a frame body to support the middle boards 20.

In the embodiment, the sub members 10 and 10' have an identical configuration. One of the sub members 10 and 10' is provided above the other of the sub members 10 and 10'. The sub member 10' on an upper side is arranged such that a top-to-bottom direction thereof is inverted with respect to that of the sub member 10 on a lower side.

The plug connector 40 is connected to the middle connector 1 from above, and the fixed connector 40' connected to the middle connector 1 from below. The plug connector 40 and the fixed connector 40' have also an identical configuration. The plug connector 40 is arranged such that a top-to-bottom direction thereof is inverted with respect to that of the fixed connector 40'.

In the embodiment, the circuit boards, the circuit members (not shown), are attached to the plug connector 40 and the fixed connector 40'. In many cases, the circuit board attached to the fixed connector 40' is fixed inside the electrical device. In FIG. 1, the plug connector 40 on an upper side and the fixed connector 40' on a lower side are attached to the circuit boards to be electrically connected through solder balls provided in terminals thereof on a top surface and a bottom surface thereof, respectively.

As described, the sub members 10 and 10' have an identical configuration, and the plug connector 40 and the fixed connector 40' have an identical configuration, respectively. In the specification, each one of the members, i.e., the sub member 10 and the plug connector 40, will be explained.

In the embodiment, the sub member 10 is made of an electrically insulative member. A frame portion 11, crosswise members 12, and a lengthwise member 13 are molded integrally to form the sub member 10. The frame portion 11 has a rectangular planar shape. A plurality of the crosswise members 12 extends in parallel inside the frame portion 11 in a longitudinal direction of the frame portion 11. The lengthwise member 13 extends to connect the plurality of the crosswise members 12 at a center position thereof in the longitudinal direction. The frame portion 11 is provided with main arm portions 15 and sub-arm portions 16 to extend from the frame portion 11 on outside surfaces of walls facing each other in the longitudinal direction.

The frame portion 11 of the sub member 10 forms a guide frame 11A on an upper surface thereof facing the plug connector 40. The upper surface is a surrounding wall of the guide frame 11A taller than that of an upper surface of the crosswise members 12 and the lengthwise member 13 or edge portions of the middle board protruding from there (described later).

The plug connector 40 is guided with an inner surface of the guide frame 11A, and is fitted to the plug connector 40. The crosswise member 12 and the adjacent crosswise member 12 form a reception groove 14 therebetween to pass through top to bottom. The reception groove 14 receives an edge portion area of the middle board of the middle connector 1 (described later).

As shown in FIG. 1, nine of the reception grooves 14 formed in an arrangement direction of the crosswise member 12 are provided in both sides of the lengthwise member 13. That is, the lengthwise member 13 is a divider to divide the reception grooves 14 extending to both sides thereof. A part of the divider is formed in a holding portion 13A (a holding portion 13'A of the sub member 10' shown in FIG. 1) with respect to the middle board.

As shown in FIG. 1, protrusions 14A and 14B are provided at two different positions of the reception grooves 14 in a longitudinal direction thereof. Each of the protrusions 14A and 14B is provided on an inner surface of the reception groove 14 facing each other. The protrusions 14A and 14B protrude in a groove width direction of the reception groove 14 by a distance substantially the same as or slightly larger than a thickness of the middle board (described later). Accordingly, the protrusions 14A and 14B have a groove width such that a space is formed in portions other than the protrusions with respect to the middle board when the middle board is accommodated.

In the embodiment, the main arm portions 15 and the sub-arm portions 16 are provided outsides walls of the frame portion 11 facing each other in a longitudinal direction thereof. The main arm portions 15 and the sub-arm portions 16 have an inverted U-character section and a free edge side elastically displaceable. The main arm portion 15 is situated in a center portion of the wall in a width direction thereof, while the sub-arm portions 16 are situated on both sides of the main arm portion 15.

The main arm portion 15 and the sub-arm portion 16 displace elastically in different directions perpendicular to each other. The main arm portion 15 displaces elastically in a direction to move apart from the wall surface, while the sub-arm portion 16 displaces elastically in a direction along the wall surface.

A sectional view of the main arm portion 15 is an inverted U-shape. A side surface of the main arm portion 15 perpendicular to the wall has a cut portion in an upper center portion to form a U-shape. A bottom surface of a cut portion 15A is an engagement surface 15B. A sectional view of the sub-arm portion 16 is an inverted U-shape. An adjacent protrusion 16A is provided on an outside surface of the free edge of the sub-arm portion 16. A specific amount of a space is provided between the sub-arm portion 16 and a side edge of the main arm portion 15.

In the embodiment, the middle boards 20 are provided at positions having a number same as that of the reception grooves 14 of the sub member 10. As shown in FIG. 1, nine of the reception grooves 14 are arranged. Accordingly, nine of the middle boards 20 are provided. Note that only two of the middle boards 20 are shown in FIG. 1 and the others of the middle boards 20 are omitted.

Each of the middle boards 20 is provided with cut portions 21 and 22 having groove shapes at center positions of top and bottom edge portions, respectively. The holding portion 13A of the sub member 10 enters the cut portions 21 and 22. Top and bottom edge portions 23 and 24 having enough lengths to insert into the two reception grooves 14 extending to both sides of the holding portion 13A of the sub member 10 are provided on both sides of the cut portions 21 and 22.

Right and left ends of the top and bottom edge portions 23 and 24 have spaces δ (shown in FIG. 2) between the reception groove 14 and a reception groove 14' of the sub members 10 and 10'. The top and bottom edge portions 23 and 24 are allowed to relatively move to a right-to-left direction thereof between the middle board 20 and the sub members 10 and 10'. That is, the sub members 10 and 10' constituting a part of a frame body have a degree of freedom to relatively move in the right-to-left direction with respect to the middle board 20, and engage with each other in an insert and pull-out direction.

Figure 2:
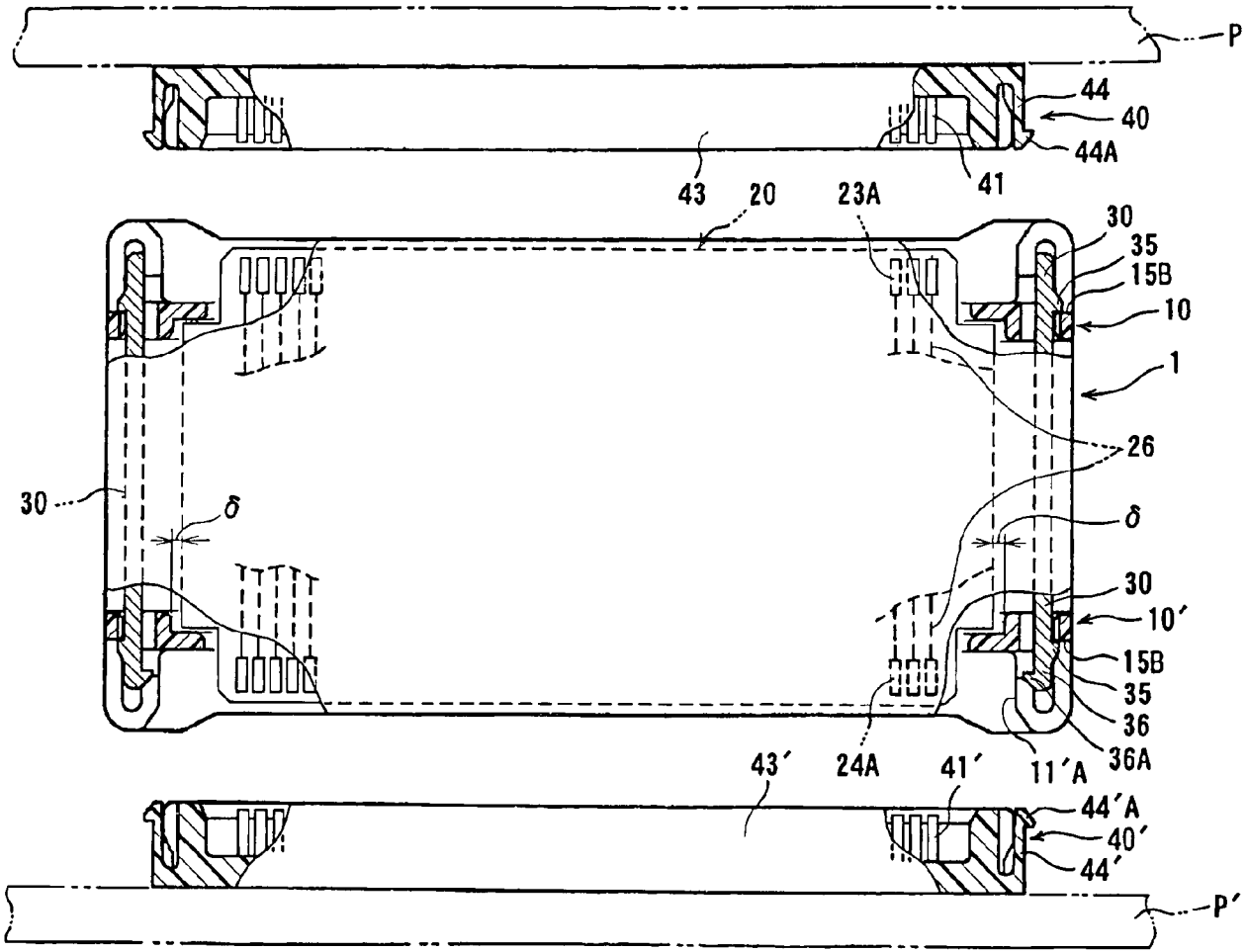
FIG. 2 is a partial sectional view showing a fixed connector, a middle connector, ad a plug connector of the electrical connector assembly in a state before assembly according to the embodiment of the present invention.

As shown in FIG. 2, each area of the edge portions 23 and 24 is provided with connection pads 23A and 24A at a specific interval to correspond with the terminals along the edge portions 23 and 24. The connection pads 23A and 24A are contact portions having flat surfaces to contact with a plurality of terminals (not shown) of the plug connector 40 and the fixed connector 40'. The corresponding connection portions 23A and 24A provided in the top and bottom edge portions 23 and 24 are provided on a board surface and short-circuited each other through a circuit portion 26 (shown partially).

As shown in FIG. 1, the joining member 30 has a plate portion 31 at a center portion thereof, and columnar portions 32 extending along top to bottom are disposed on both side portions of the plate portion 31. The protrusion portions 33 extend from the columnar portions 32 to sides. Further, an upper protrusion portion 34 and a lower protrusion portion 35 extending in a horizontal direction are provided with a space on an outside surface of the plate portion 31. A top edge of the upper protrusion portion 34 is a taper portion 34A. Further, an engagement portion 36 having a leg shape extends from a lower edge of the plate portion 31. A claw portion 36A is provided in an inner side of a distal of the engagement portion 36.

A portion of the columnar portion 32 above a protrusion portion 33 enters between the main arm portion 15 of the sub-arm portion 16 of the sub member 10. The columnar portion 32 presses the sub member 16 at an adjacent protrusion 16A, so that the sub-arm portion 16 can elastically displace. At the same time, the plate portion 31 enters a groove portion from a top edge of the plate portion 31.

The main arm portion 15 having an inverted U-shape of the sub member 10 opens downwardly to form the groove portion. When the plate portion 31 enters to a specific position while elastically displacing the main arm portion 15 of the upper protrusion portion 34, the protrusion portion 33 is situated adjacent to a step portion 17 on a side of the sub-arm portion 16. Further, the upper protrusion portion 34 reaches the cut portion 15A of the main arm portion 15 to release the elastic displacement and engages with the engagement surface 15B to prevent the joining portion 30 from coming off.

A portion having the engagement surface 15B of the main arm portion 15 of the top and bottom sub members 10 and 10' is accommodated between the upper protrusion portion 34 and the lower protrusion portion 35. Further, each of the engagement surfaces 15B engages with the upper protrusion portion 34 and the lower protrusion portion 35. In the joining member 30, a bottom edge side of the columnar portion 32 engages with the sub member 10' in a lower portion, while the top edge side of the columnar portion 32 engages with the sub member 10 in an upper portion in the same manner.

In the embodiment, the plug connector 40 and the fixed connector 40' shown in FIG. 1 have an identical configuration. With regards to the plug connector 40, the plug connector 40 (fixed connector 40') is connected through the middle boards 20. There is no limit to a shape of the plug connector 40. Terminals 41 or contact portions are connected to fit into the connection pads 23A and 24A of the top edge portions 23 and the bottom edge portions 24 of the middle boards 20, respectively, to be arranged inside of grooves 42 (grooves 42' in the fixed connector).

A side surface of a housing 43 of the plug connector 40 is provided with an engagement portion 44 that is a bendable arm having an inverted U-shape (U-shape in the fixed connector 40') formed interdependently with the side surface. Further, a claw portion 44A is provided in a distal of this engagement portion 44. The claw portion 44A can engage with a claw portion 36A provided in a distal of the engagement portion 36 of the joining member 30.

As shown in FIG. 1, on a top surface of the plug connector 40, solder balls 41A are provided on protrusion portions of the terminals 41, and the top surface of the plug connector 40 is attached to the circuit board (not shown). Further, a boss portion 45 having a rectangular shape and boss portions 46 having columnar shapes are provided at four corners of the housing 43 of the plug connector 40. The boss portions 45 and 46 determine a position of the plug connector 40 with respect to the circuit board.

The connector assembly according to the embodiment is, for example, assembled and used as below.

First, the plug connector 40 and the fixed connector 40' situated at the top and bottom are attached to the corresponding circuit boards P and P' (shown in FIG. 2), respectively. Then, each of the terminals 41 is electrically connected with the corresponding circuit through the solder ball 41A and provides a connector having a circuit board.

Figure 3:
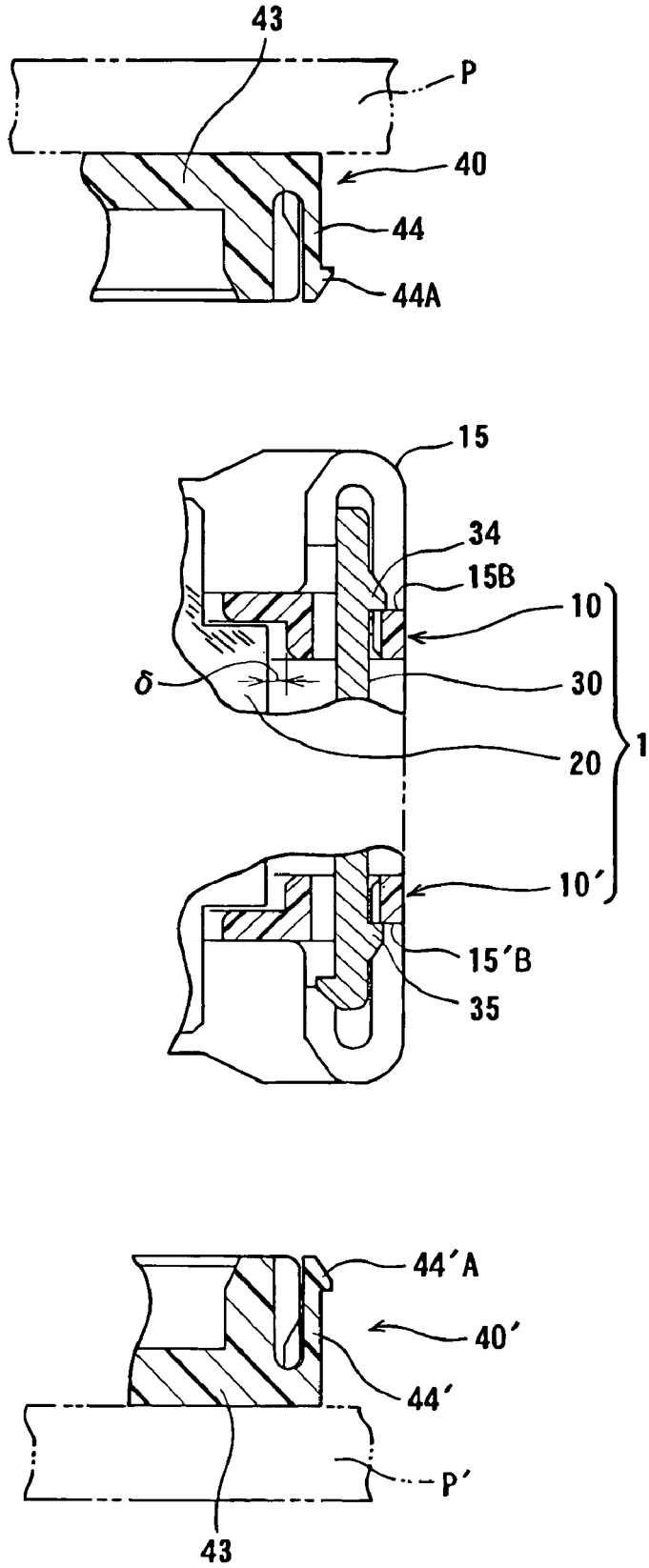
FIG. 3 is an enlarged view of the electrical connector assembly according to the embodiment of the present invention.

Next, when the middle connector 1 is assembled, as shown in FIG. 2, the joining members 30 are attached to the sub member 10' on the lower portion thereof. As shown in FIG. 3, the lower protrusion portion 35 of the joining member 30 engages with the engagement surface 15B of the sub member 10' to prevent the joining member 30 from being displaced. FIG. 3 is an enlarged figure of a main portion of FIG. 2.

Next, the middle boards 20 are attached to the sub member 10' having the joining members 30 attached. The middle board 20 loosely fits into and is to be held at the holding portion 13'A of the sub member 10' in the cut portion 22 provided in a lower portion of the middle board 20 (shown in FIG. 1). The bottom edge portion 24 of the middle board 20 is accommodated in the reception groove 14' of the sub member 10' and supported by the protrusions 14'A and 14'B inside the reception groove 14' in a thickness direction of the middle board 20.

After that, the sub member 10 on an upper portion is connected with the sub member 10' on a lower portion through the joining members 30. The connection is done in the same manner as the connection of the joining members 30 and the sub member 10' in the lower portion. Further, the upper protrusion portion 34 of the joining member 30 engages with the engagement surface 15B of the sub member 10 to prevent the joining member 30 from coming off. Further, the top edge portion 23 of the middle board 20 is accommodated in the reception groove 14 of the sub member 10 and is supported at the facing protrusions 14A and 14B. Thus, as shown in FIG. 2, the middle connector 1 comprising the sub members 10 and 10' and the joining member 30 is completed.

Next, the middle connector 1 is connected to the fixed connector 40' having the circuit board through the joining members 30. The sub member 10 on an upper portion and the sub member 10' on a lower portion are connected to constitute the middle connector 1.

When connecting, the fixed connector 40' and the sub member 10' of the middle connector 1 are positioned through guiding each other in an inner surface of a guide frame 11'A (refer to the guide frame 11A provided in the sub member 10) of the sub member 10'. Further, the connection pad 24A provided in the lower edge portion 24 of the middle board 20 of the middle connector 1 is electrically connected with the terminals 41 of the fixed connector 40'.

The joining member 30 of the middle connector 1 engages with a claw portion 44'A to connect with the fixed connector 40' after the engagement portion 36 and the claw portion 36A thereof bend an engagement portion 44' having an elastic arm shape. Further, the engagement prevents the middle connector 1 from coming off from the fixed connector 40'.

After that, the plug connector 40 having the circuit board in an upper portion is accommodated inside of the guide frame 11A of the sub member 10 in an upper portion. Further, the terminals of the plug connector 40 are electrically connected with the connection portions 23A of the top edge portions 23 of the middle boards 20. Thus, as shown in FIG. 4, the connector assembly is obtained.

Figure 4:
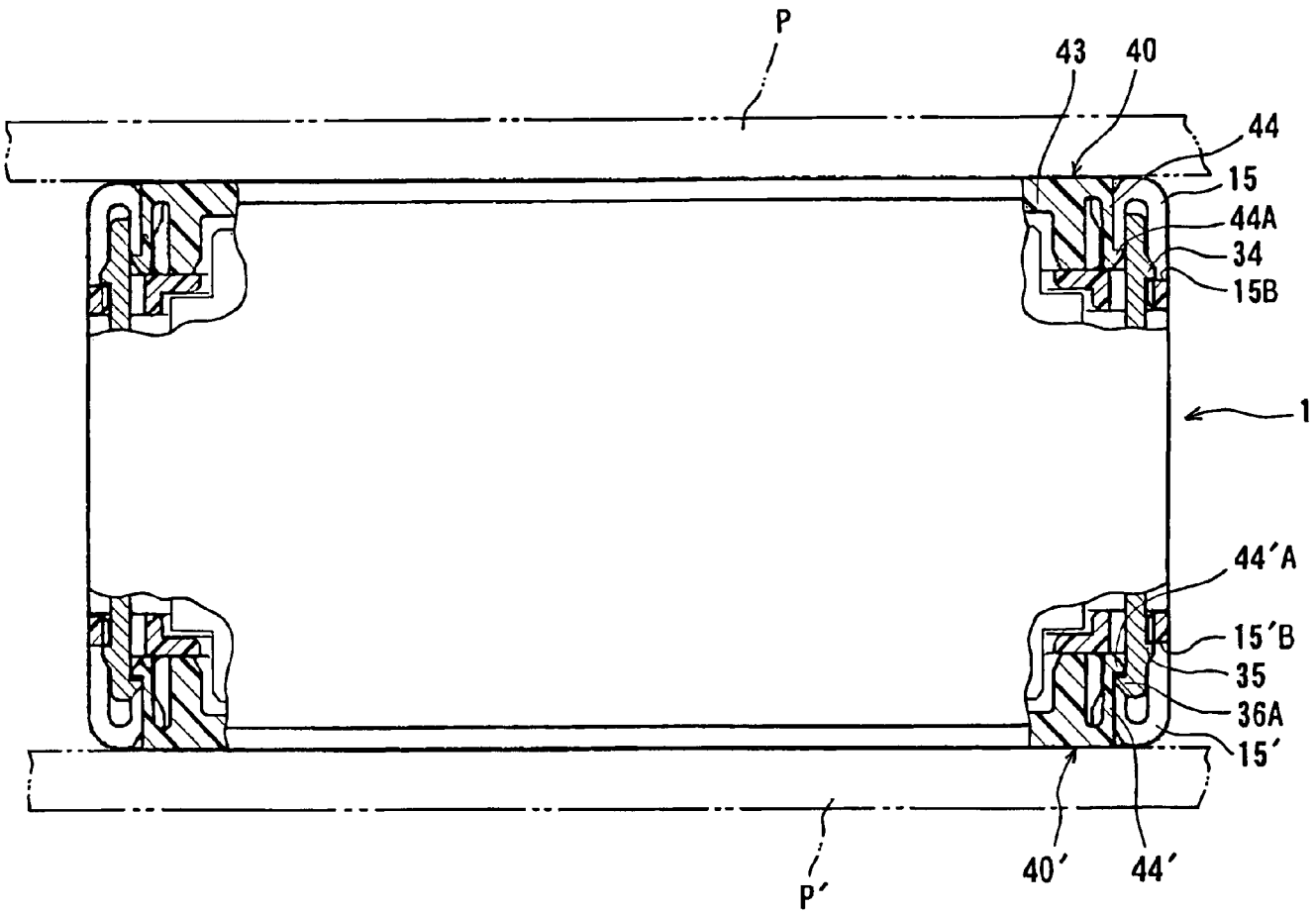
FIG. 4 is a partial sectional view showing the electrical connector assembly in a state after assembly according to the embodiment of the present invention.
Figure 5:
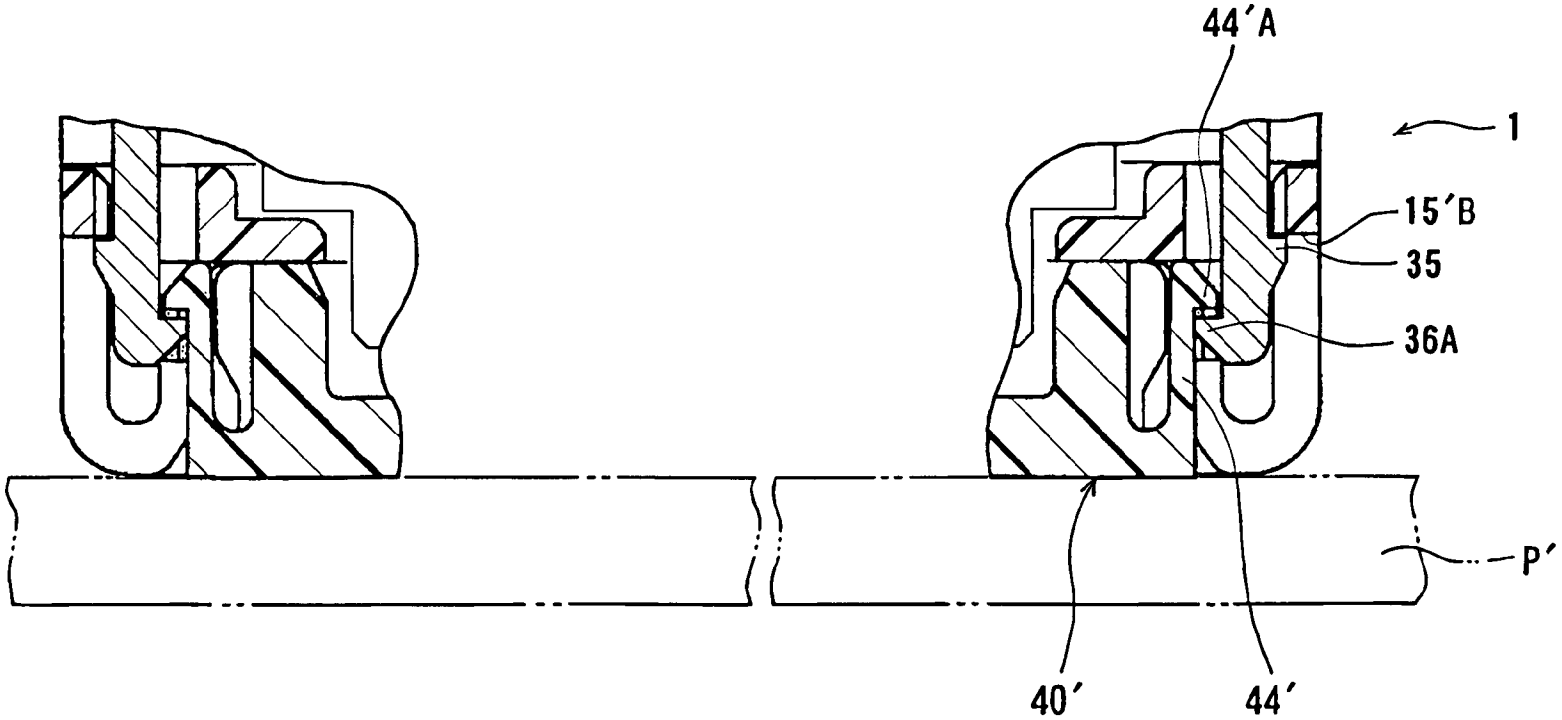
FIG. 5 is an enlarged view of the electrical connector assembly after assembly according to the embodiment of the present invention.

FIG. 5 shows an enlarged view of a lower portion of FIG. 4. The claw portions 44A of the engagement portions 44 having elastic arm shapes of the plug connector 40 are situated adjacent to the inner surfaces of the joining members 30 to bend and hold the plug connector 40 and the middle connector 1 through elasticity.

Thus, the plug connector 40 and the fixed connector 40' are electrically connected through the middle boards 20 of the middle connector 1. The terminals 41 and 41' of the plug connector 40 and the fixed connector 40' contact with the connection pads 24A and 23A of the middle boards 20, respectively, in flat surfaces. Further, the terminals 41 and 41' are slidable in a right-to-left direction with respect to the connection pads 24A and 23A at a specific distance. The specific distance is corresponded with a bending amount of the engagement portion 44' that is enough to release an engagement between the claw portions 36A and 44'A.

Next, a pull-out method of the plug connector 40 and the fixed connector 40' will be explained. The plug connector 40 may be pulled out from the middle connector 1 only when the plug connector 40 or the circuit board P connected to the plug connector 40 is lifted upwardly. The plug connector 40 and the middle connector 1 are fitted to each other through solely plugging force of each other.

In the embodiment, the claw portions 44A of the engagement portions 44 are not hooked with the joining members 30 of the middle connector 1. Accordingly, the plug connector 40 and the middle connector 1 are separated upwardly with ease.

At this time, the claw portions 36A of the engagement portions 36 provided in the joining members 30 of the middle connector 1 are hooked to the claw portions 44'A provided in the engagement portions 44' of the fixed connector 40'. Accordingly, the middle connector 1 and the fixed connector 40' in a lower portion engage with each other. As a result, the middle connector 1 and the fixed connector 40' do not come off through pulling out of the plug connector 40 upwardly.

In the embodiment, the claw portions 36A and the claw portions 44'A are engaged with each other. Accordingly the middle connector 1 may not be pulled out from the fixed connector 40' in a lower portion simply by pulling the middle connector 1 upwardly. As a result, the middle connector 1 is pushed once to, for example, left in a horizontal direction. The claw portions 36A of the engagement portions 36 provided in a lower portion of one of the joining members 30 (the joining member 30 on a right portion in FIG. 6) of the middle connector 1 may push one of the engagement portions 44' (the engagement portion 44' in a right portion in FIG. 6) having elastic arm shapes of the fixed connector 40' in a lower portion to bend to a left portion.

Figure 6:
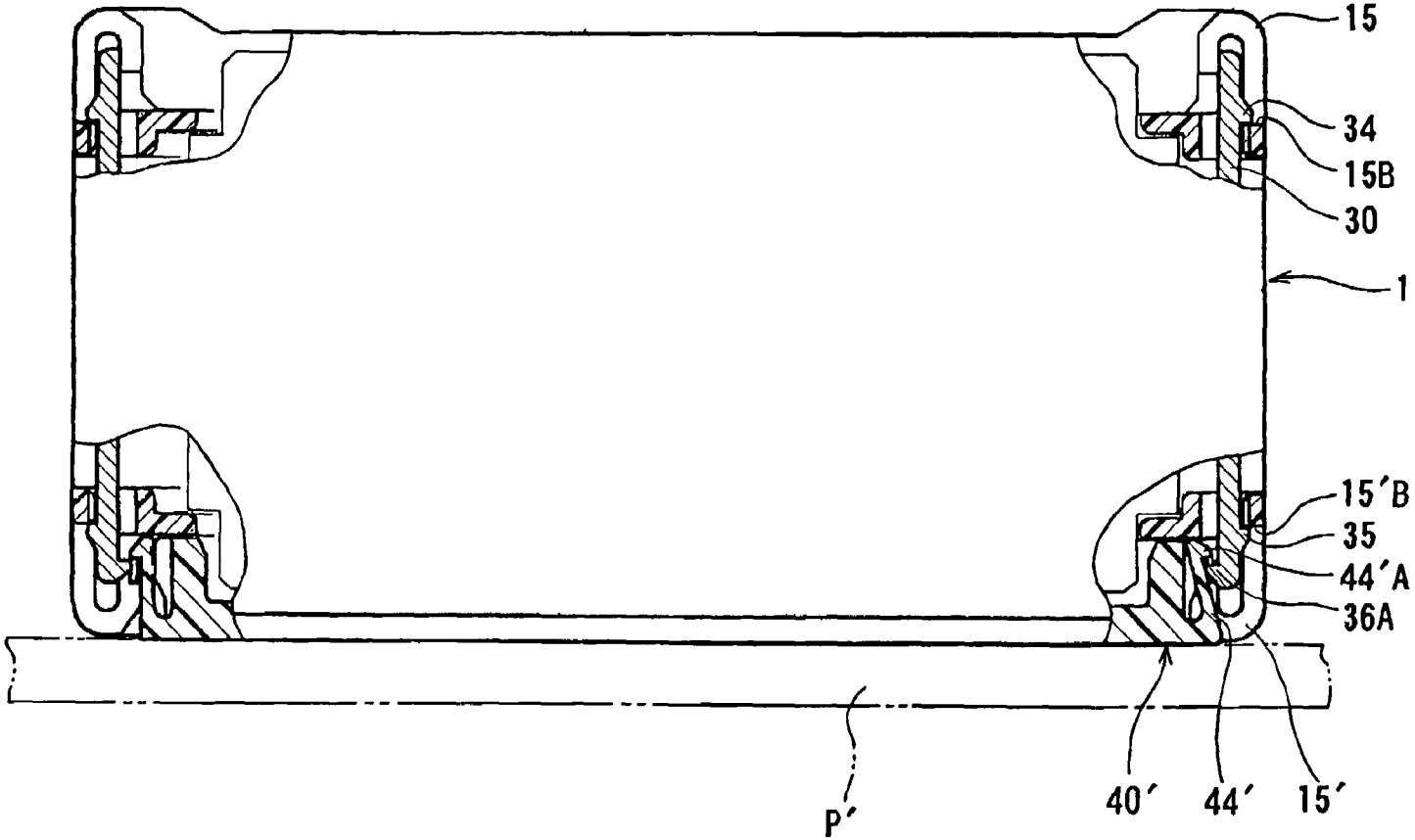
FIG. 6 is a partial sectional view showing the electrical connector assembly just before the middle connector is pulled out from the fixed connector according to the embodiment of the present invention.
Figure 7:
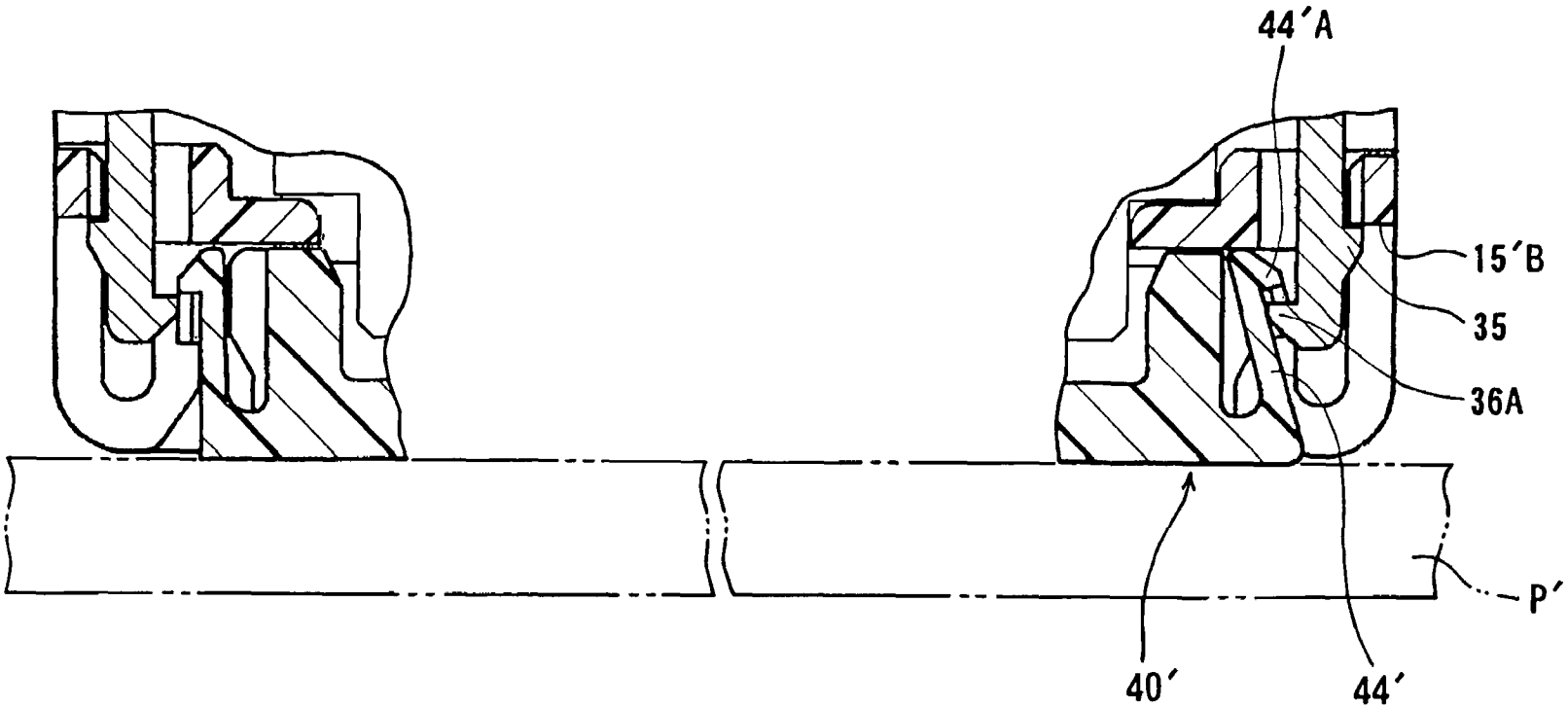
FIG. 7 is an enlarged view showing a lower portion of the electrical connector assembly according to the embodiment of the present invention.

FIG. 7 is a view showing an enlarged figure of a lower portion of FIG. 6. The middle connector 1 moves to a left portion as much as the bent portion. This movement releases the claw portions 36A of the engagement portions 36 from an engagement with the claw portions 44'A of the other engagement portions 44' (the engagement portion 44' in a left portion in FIG. 6) of the fixed connector 40'.

Figure 8:
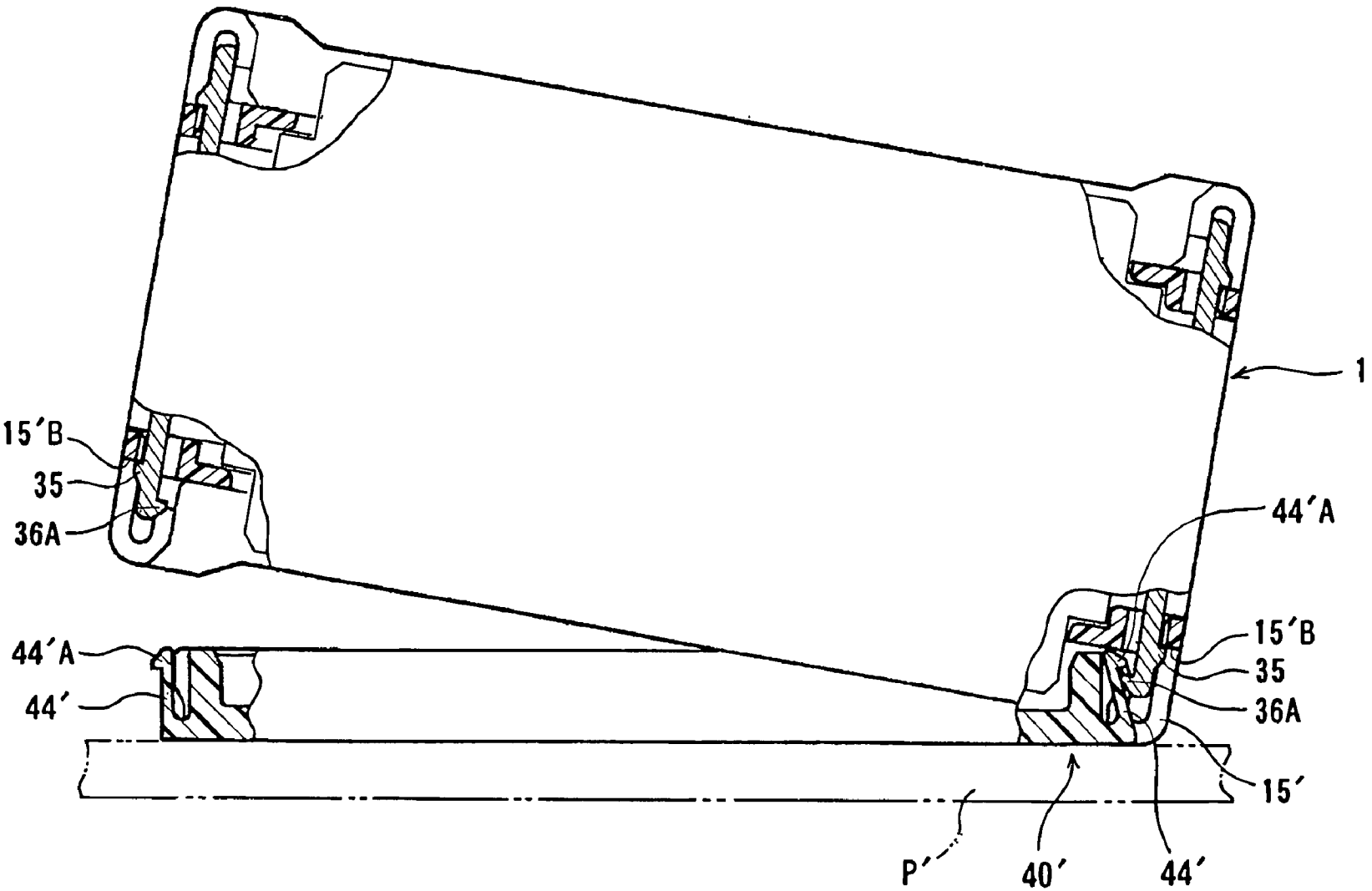
FIG. 8 is a partial sectional view showing the electrical connector assembly when the middle connector is pulled out from the fixed connector according to the embodiment of the present invention.

The claw portions 36A of the engagement portions 36 are provided in a lower portion of the other joining member 30 (the joining member 30 in a left portion in FIG. 6) of the middle connector 1. Further, the engagement portion 44' has an elastic arm shape. When the middle connector 1 is to be lifted upwardly at this time, a left portion side of the middle connector 1 is lifted to be inclined as shown in FIG. 8.

When the middle connector 1 is to be lifted while returning to a right portion, the middle connector 1 is completely pulled out from the fixed connector 40' in a lower portion. The middle connector 1 may not move to left with respect to the fixed connector 40' since the cut portions 22 of the middle boards 20 engage with a top edge of a lengthwise wall 45' of the fixed connector 40'. The middle connector 1 may move with respect to the middle boards 20 of the sub member 10' constituting a part of the frame body of the middle connector 1.

The present invention is not limited to the embodiment shown in the figures. For example, even though the claw portions of the engagement portions of the middle connector and the fixed connector do not engage with each other, one of the engagement portions may be the claw portion and the mating engagement portion may be a hole portion in which the claw portion engages.

Further, a direction of a relative move of the middle connector and the fixed connector to release the engagement when the middle connector has a plurality of the middle boards may not be parallel to surfaces of the middle boards but may be perpendicular to the surfaces. That is, the engagement portions are provided on both ends of the perpendicular direction. It becomes preferred when the number of the middle boards increases because a distance between the both ends becomes longer.

The disclosure of Japanese Patent Application No. 2007-329660, filed on Mar. 30, 2007, is incorporated in the application by reference.

While the invention has been explained with reference to the specific embodiments of the invention, the explanation is illustrative and the invention is limited only by the appended claims.

What is claimed is:

1. An electrical connector assembly comprising:

a fixed connector to be attached to a circuit member of an electronics device, said fixed connector including a first engagement portion, said first engagement portion including a first arm portion and a first claw portion disposed on a distal end portion of the first arm portion;

a middle connector connected to the fixed connector along a first direction, said middle connector including a second engagement portion and a third engagement portion, said second engagement portion engaging the first engagement portion with a first engagement force, said middle connector being arranged to be movable in a second direction perpendicular to the first direction for a specific distance with respect to the fixed connector so that the second engagement portion is disengaged from the first engagement portion when the middle connector moves with respect to the fixed connector, said second engagement portion including a second arm portion and a second claw portion disposed on a distal end portion of the second arm portion; and a plug connector connected to the middle connector along the first direction, said plug connector including a fourth engagement portion engaging the third engagement portion with a second engagement force smaller than the first engagement force.

2. The electrical connector assembly according to claim 1, wherein said middle connector includes the second engagement portion at both end portions thereof in the second direction.

3. The electrical connector assembly according to claim 2, wherein said second engagement portion at least one of the both end portions is arranged to be disengaged from the first engagement portion when the middle connector moves with respect to the fixed connector.

4. The electrical connector assembly according to claim 1, wherein said middle connector further includes a first contact portion for connecting with a first terminal of the fixed connector and a second contact portion for connecting with a second terminal of the plug connector.

5. The electrical connector assembly according to claim 1, wherein said middle connector further includes a middle board for conducting the fixed connector and the plug connector and a frame body for supporting the middle board to be movable so that the middle connector moves with respect to the fixed connector.

6. An electrical connector assembly comprising, a fixed connector to be attached to a circuit member of an electronics device, said fixed connector including a first engagement portion, said first engagement portion including a first arm portion and a first claw portion disposed on a distal end portion of the first arm portion;

a middle connector connected to the fixed connector along a first direction, said middle connector including a second engagement portion and a third engagement portion, said second engagement portion engaging the first engagement portion with a first engagement force, said middle connector being arranged to be movable in a second direction perpendicular to the first direction for a specific distance with respect to the fixed connector so that the second engagement portion is disengaged from the first engagement portion when the middle connector moves with respect to the fixed connector; and a plug connector connected to the middle connector along the first direction, said plug connector including a fourth engagement portion engaging the third engagement portion with a second engagement force smaller than the first engagement force, wherein said first arm portion extends from a side surface of the fixed connector along the side surface to form a space in between so that the first arm portion deforms in the second direction when the middle connector moves with respect to the fixed connector.

7. The electrical connector assembly according to claim 6, wherein said fixed connector includes the first engagement portion at both end portions thereof in the second direction, said first arm portion of the first engagement portion at one of the both end portions deforming in the second direction when the middle connector moves with respect to the fixed connector so that the second engagement portion is disengaged from the first engagement portion at the other of the both end portions.

* * * * *